United States Patent [19]

Derrwaldt

[11] 4,113,237

[45] Sep. 12, 1978

[54] CABLE TENSION CONTROL

[75] Inventor: Philip A. Derrwaldt, Mukwonago, Wis.

[73] Assignee: D. G. Beyer, Inc. Milwaukee, Wis.

[21] Appl. No.: 625,822

[22] Filed: Oct. 28, 1975

[51] Int. Cl.[2] ..... B66D 1/76

[52] U.S. Cl. ..... 254/175.7; 226/113; 254/138

[58] Field of Search ..... 254/134.3, 138, 139.1, 254/175.7, 172, 158, 173 R, 175.5; 226/113, 114, 195; 242/54 R

[56] References Cited

U.S. PATENT DOCUMENTS

| | | | |
|---|---|---|---|
| 2,396,852 | 3/1946 | Illmer | 242/54 R |
| 2,443,028 | 6/1948 | Edwards | 254/172 |
| 2,678,173 | 5/1954 | Phelps | 226/113 X |
| 2,862,673 | 12/1958 | Smaltz | 242/54 R |
| 3,037,720 | 6/1962 | Leithiser | 254/134.3 R |
| 3,057,162 | 10/1962 | Lee | 254/172 X |
| 3,801,071 | 4/1974 | Barron | 254/173 R |
| 3,879,016 | 4/1975 | Kankkunen | 254/158 |

*Primary Examiner*—Robert B. Reeves
*Assistant Examiner*—Fred A. Silverberg

[57] ABSTRACT

A cable pay-out drive is positioned between the winch drum and a clam shell supported by the cable. To lower the clam shell, the pay-out drive pulls cable from the drum under constant tension. To raise the clam shell, the winch drum retrieves cable, again with the cable under constant tension between the drum and pay-out drive. One sheave of the pay-out drive is mounted for movement in response to the load of the clam shell on the cable and that sheave is associated with a load cell which translates the cable load into a gauge reading so that the magnitude of the load being raised is continuously monitored from within the crane cab.

5 Claims, 4 Drawing Figures

CABLE TENSION CONTROL

BACKGROUND OF THE INVENTION

This invention relates to cranes and, more particularly, to the cable drives for cranes.

The versatility afforded by the use of clam shells is well recognized and they are used with various types of cranes. Some general purpose type cranes are not suited to use with clam shells even though they are equipped with hoist arrangements which could be used to raise and lower a clam shell. In such cranes the cable is both driven off a winch drum (paid-out) and powered back by being recoiled on the drum. In such arrangements the cable is strung along a boom and over idler sheaves to a ball and hook on which the clam shell is supported. One of the problems is that as the clam shell is lowered into engagement with a particular load to be raised, the danger exists that cable will continue to be paid-out even after the downward movement of the clam shell has been interrupted. The weight of the clam shell no longer maintains tension on cable and excess cable paid-out will snarl at the winch drum much in the nature of a snarled line on a fishing reel due to a "backlash". Since heavy duty cable is involved, this snarled condition is extremely difficult to clear.

This invention is concerned with this problem and has as one of its general objects the provision of a cable pay-out and retrieval arrangement which eliminates the possibility of a snarled cable at the winch drum.

Another general object of this invention is to provide a cable drive arrangement which has universal applicability to various types of cranes permitting use of clam shells, and the like, with virtually any type of crane.

A more specific object of this invention is to provide such a cable drive arrangement in association with means for continuously monitoring the load on the cable.

SUMMARY OF THE INVENTION

For the achievement of these and other objects, this invention proposes an arrangement wherein cable is drawn from a drum by a pay-out drive mechanism spaced from and driven separately of the drum. The pay-out drive maintains constant tension on the cable between it and the drum so that the cable is always in a taut condition as it leaves the drum. The cable is paid-out to a load engaging mechanism located, relative to the direction of cable pay-out, downstream of the drive arrangement. Any relaxation of the cable due to interruption of the downward travel of the load engaging mechanism occurs downstream of the pay-out drive and not at the drum.

The drum drive retrieves the cable to raise the load engaging mechanism but the cable must be retrieved through the pay-out drive and is maintained under constant tension as it is coiled on the drum.

This invention further proposes to provide means for monitoring the load on the cable, and thus the entire hoist arrangement, even though the operator's direct view of the load engaging means may be obstructed. Preferably this takes the form of an element in the pay-out drive being supported for movement in response to increased load on the cable, this movement being in addition to normal pay-out or retrieval movement. This movable element is associated with a conventional load cell connected in turn to a read-out gauge in the control cab of the crane. The load cell translates the position of the element or element movement, which are directly related to cable load, to a gauge reading so that cable load is continuously monitored.

Other objects and advantages will be pointed out in, or be apparent from, the specification and claims, as will obvious modifications of the embodiment shown in the drawings, in which:

DESCRIPTION OF THE PREFERRED EMBODIMENT

Figure 1:
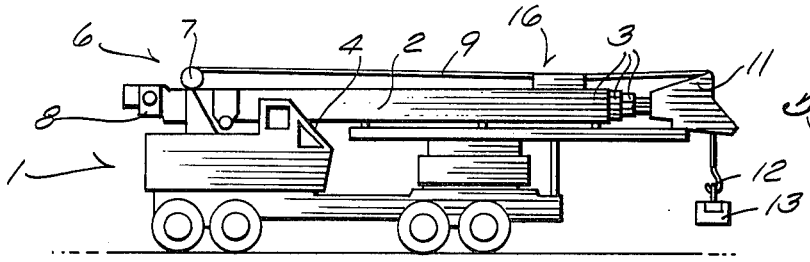
FIG. 1 is a generally schematic side elevation of a general purpose crane incorporating this invention.
Figure 2:
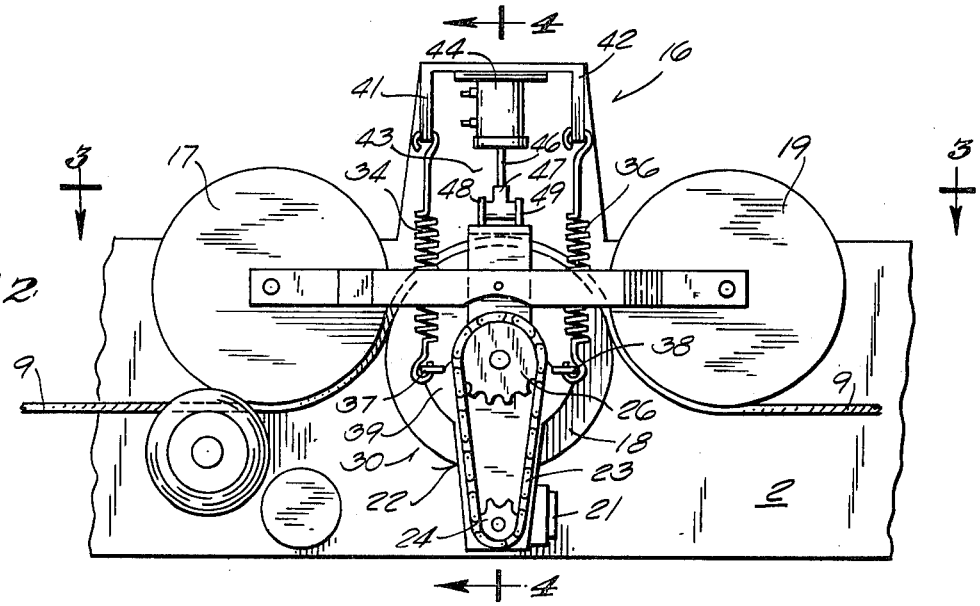
FIG. 2 is an enlarged plan view of the pay-out drive mechanism.
Figure 3:
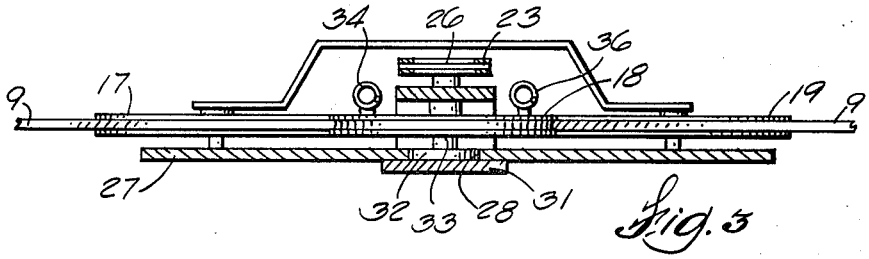
FIG. 3 is a section view along line 3—3 in FIG. 2.
Figure 4:
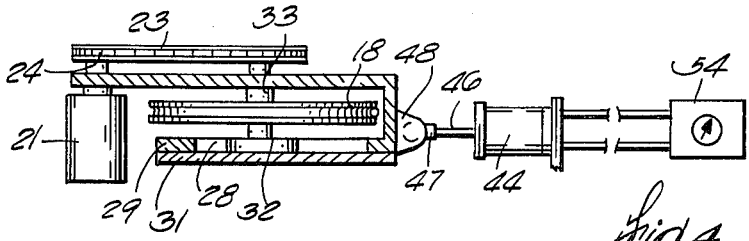
FIG. 4 is a section view generally along line 4—4 in FIG. 2 and including a schematic showing of the load monitoring arrangement.

With particular reference to FIG. 1, a mobile crane 1 includes an hydraulically operated boom 2. The boom includes telescopic sections 3 which are extended and retracted through operation of conventional hydraulic mechanisms (not shown). The boom is pivoted in a vertical plane about its left end, as viewed in FIG. 1, to raise and lower the free end of the boom, again by conventional hydraulic mechanisms (not shown). This type of crane and boom arrangement is typical of conventional general purpose type cranes which, heretofore, have not been particularly well suited to use with load engaging mechanisms such as a conventional clam shell. Although this invention will be described as embodied in such a crane arrangement, it should be appreciated that it is not necessarily so limited.

A winch arrangement 6 is supported adjacent the pivot end of the boom and includes a drum 7 and a conventional drum drive 8. Cable 9 is coiled on the drum and the drum drives rotates the drum in a counter-clockwise direction to wind cable on the drum and the drum is freely rotatable in an opposite direction when the cable is paid-out from the drum.

The cable extends along the length of the boom and is reaved on a sheave adjacent the free end 11 of the boom. The cable supports a ball and hook arrangement 12 which in turn detachably supports a conventional clam shell 13.

Ordinarily, the clam shell is lowered either to the ground or to engage a particular article or other type load which is to be raised and moved to a different location. For effective manipulation of the load, it is desirable that the cable and clam shell, and correspondingly, the load carried by the clam shell, be powered both in a pay-out and retrieval direction, i.e., the cable be driven both to lower and raise the ball and hook arrangement.

A problem in accomplishing this through an arrangement wherein the cable is powered in both directions by the winch drive is that at times the load and the clam shell may be obstructed from the operator's view, the operator being located in a cab 4 in the mobile crane. Should downward travel of the clam shell be interrupted without the knowledge of the operator, cable will continue to be paid-out. The cable will go slack but the slackened cable does not accumulate only adjacent the clam shell but also accumulates in the area of the winch drum. This can cause severe tangling of the cable in that area, much in the nature of a snarled fish line which occurs as a result of a "backlash" on a fishing reel. Since heavy duty, relatively stiff cable is involved, it is extremely difficult to free a snarled condition of that type.

This invention proposes to eliminate that problem by insuring that the cable being paid out from the winch drum is continuously in a taut condition as it is being paid off of the drum so that it cannot snarl at the drum regardless of the amount of cable paid-out or whether the clam shell movement is free or obstructed.

More specifically, in accordance with this invention, the winch drum is made to rotate freely in the pay-out direction, i.e., clockwise in the drawing illustration. The cable is reaved through a cable pay-out drive assembly 16 supported on the boom intermediate the boom ends. This pay-out drive assembly incorporates its own drive mechanism which is separate from that of the winch drum and is effective to pull cable through the pay-out drive assembly off of the winch drum with the length of cable between the winch drum and the pay-out drive being under continuous tension. Accordingly, should cable continue to be paid-out after downward travel of the clam shell is interrupted, slack cable will occur in the area of the free end of the boom, or clam shell, and not in the area of the winch drum. When the clam shell is raised, power for that operation is provided by the winch drum drive mechanism 8 and the pay-out drive accommodates that pay-out movement by running relatively free in the retrieval direction.

In the preferred embodiment of the pay-out drive, tension is maintained on the cable length by reaving cable 9 through three offset sheaves 17, 18, and 19. End sheaves 17 and 19 are located with their axis in alignment and the intermediate sheave 18 has its axis offset from the end two. This defines a nonlinear path for the cable through the pay-out drive, i.e., under the end sheaves and over the intermediate sheaves, and maintains the cable in a taut condition in the pay-out direction.

The drive of the cable pay-out drive assembly is provided by a hydraulic motor 21 and a chain and sprocket arrangement 22. Chain 23 extends between a sprocket 24 connected to the hydraulic motor drive shaft and a second sprocket 26 connected to middle sheave 18. Hydraulic fluid for the hydraulic motor can be provided from the general hydraulic system of the crane and controlled through a conventional type hydraulic circuit (not shown).

When the cable is paid out, the intermediate sheave is rotated by motor 21 in a clockwise direction as viewed in the drawings. Cable is pulled over the end sheave 17 which maintains the cable in a taut condition regardless of the load condition on the cable downstream of the other end sheave 19.

Another problem which may be encountered, again due to the fact that the operator's direct view of the clam shell from the cab may be obstructed, is that the upward movement of the clam shell may be either interrupted or an excessively large load, beyond the capacity of the crane, may be engaged. In either case, the hydraulic lift system will attempt to raise the load increasing the load on the cable, its drive and boom which could result in damage to any one or all of those elements if continued. To counter this problem, this invention contemplates the provision of an arrangement for continuously monitoring the load on the cable and providing a visual read out for the operator in cab 4 which corresponds to that load.

More specifically, in the preferred embodiment, intermediate sheave 18 is supported for movement in addition to its rotational movement when the cable is either being paid out or retrieved. In the preferred embodiment, sheave 18 is mounted on a support bracket 27 connected between end sheaves 17 and 19. Bracket 27 includes a slot 28 formed by cutting through the thickness of base 29 of the bracket and backing that cut with plate 31, the upper surface of which is flush with the underside of base 29. Plate 32 is welded to the shaft 33, on which sheave 18 rotates, and fits tightly into slot 28. The entire assembly 30 (sheave 18, hydraulic motor 21 and chain and sprockets 23, 24, and 26) moves as a unit with plate 32 as the plate slides in slot 28. With this arrangement sheave 18 is supported for movement at right angles to the longitudinal axis of the boom and to the normal path of travel of the cable through the pay-out drive.

The cable pay-out drive assembly 16 includes a pair of tension springs 34 and 36 extending between brackets 37 and 38, which are connected to plate 39 of assembly 30, and brackets 41 and 42 on shelf 43 attached to the boom. The springs hold sheave 18 in engagement with the cable.

When the cable is loaded it has a tendency to straighten between the end sheaves 17 and 19. Intermediate sheave 18, being free to move in a direction normal to the regular cable movement accommodates this tendency by moving in slot 28. The position of sheave 18 is then determined by the load on the cable and that position is directly related to cable load.

A conventional transducer 44, commonly referred to as a load cell, is mounted on shelf 43. The details of the transducer have not been shown in the drawings as they are conventional. For example, it can include a piezoelectric element in an electrical circuit including gauge 54 mounted in cab 4. As is well known, the electrical resistance of the piezoelectric element varies in accordance with the load on the element. A plunger 46 is in engagement with block 47 supported between ears 48 and 49 fixed to plate 31. Plunger 46 is connected to the piezoelectric element and applies a load on the element corresponding to the position of sheave 18. This load determines the electrical condition of the gauge circuit and the gauge read out. When assembly 30 moves as a result of increased or decreased cable load, plunger 46 moves and varies the load on the piezoelectric element accordingly and the gauge reading changes to reflect the load change on the cable. Movable sheave 18 thus senses changes in load on the cable and these changes are translated into a reading on gauge 54 which can be continuously viewed by the operator. It will be appreciated that the piezoelectric load cell is only one of a number of different types which can be utilized in connection with the movable sheave.

Although but one embodiment of the present invention has been illustrated and described, it will be apparent to those skilled in the art that various changes and modifications may be made therein without departing from the spirit of the invention or from the scope of the appended claims.

I claim:

1. A load handling arrangement comprising, in combination;

a drum, cable pay-out drive means spaced from said drum and comprising first and second sheaves, means supporting said first and second sheaves in spaced relationship and in general alignment with each other, a third sheave, means supporting said third sheave between and offset relative to said first and second sheaves, and drive means for rotating said third sheave in one direction and permitting said third sheave to be rotated freely in response to retrieval of cable by said drum, a cable reaved on said sheaves so that said cable follows a nonlinear path through said sheaves, said cable coiled on said drum and extending from said drum to said cable pay-out drive means, said cable pay-out drive means operative to draw cable from said drum and maintain constant tension on said cable between said drum and said cable pay-out means, second drive means separate from said cable pay-out drive means and connected to said drum and operative to rotate said drum in one direction to coil said cable on said drum and said drum being freely rotatable in a pay-out direction, and load engaging means connected to said cable with said cable pay-out drive means located intermediate said drum and said load engaging means so that said load engaging means is lowered by said cable pay-out drive means drawing cable from said drum and is raised by said drum retrieving cable through said cable pay-out means and so that by reason of said cable pay-out means drawing said cable from said drum in a pay-out direction and said second drive means retrieving said cable by drawing said cable through said cable pay-out means said cable is maintained under tension and in a taut condition between said drum and said cable pay-out drive means at all times.

2. The load handling arrangement of claim 1 including an elongated boom and wherein said cable extends along said boom, said load engaging means is suspended generally adjacent one end of said boom, said drum is located generally adjacent the opposite end of the boom, and said cable pay-out drive means is located on said boom intermediate said boom ends.

3. The load handling arrangement of claim 1 including means supporting one of said sheaves for movement, in addition to rotation thereof, as said cable tends to straighten due to an increased load thereon, and means operatively associated with said one sheave and operative to translate the position and movement of said one sheave into a visual read-out corresponding to the load on said cable.

4. The load handling arrangement of claim 3 including an elongated boom and wherein said cable extends along said boom, said load engaging means is suspended generally adjacent one end of said boom, said drum is located generally adjacent the opposite end of said boom, and said cable pay-out drive means is located on said boom intermediate said boom ends.

5. A load handling arrangement comprising, in combination, a drum, cable, cable pay-out drive means spaced from said drum and comprising a plurality of sheaves and means supporting said sheaves in a staggered arrangement with said cable reaved on said sheaves so that said cable follows a nonlinear path through said sheaves, said cable coiled on said drum and extending from said drum to said cable pay-out drive means, said cable pay-out drive means operative to draw cable from said drum and maintain constant tension on said cable between said drum and said cable pay-out drive means and said cable pay-out drive means being freely rotatable in the cable retrieval direction, second drive means separate from said cable pay-out drive means and connected to said drum and operative to rotate said drum in the cable retrieval direction to coil said cable on said drum and said drum being freely rotatable in the pay-out direction, load engaging means connected to said cable with said cable pay-out drive means located intermediate said drum and said load engaging means so that load engaging means is lowered by said cable pay-out drive means drawing cabld from said drum and is raised by said drum retrieving cable through said cable pay-out drive means so that by reason of said pay-out cable means drawing said cable from said drum in a pay-out direction and said second drive means retrieving said cable by drawing said cable through said pay-out drive means said cable is maintained under tension and in a taut condition between said drum and said cable pay-out drive means at all times, means supporting one of said sheaves for movement, in addition to rotation of said sheaves, in response to and in accordance with the load on said cable and to position said one sheave in accordance with the load on said cable, and means operatively associated with said one sheave and operative to translate the position and movement of said one sheave into a visual read-out corresponding to the load on said cable.

* * * * *